United States Patent [19]

Hodges et al.

[11] 4,192,246

[45] Mar. 11, 1980

[54] LAMINAR FLOW QUIET TORPEDO NOSE

[75] Inventors: Frank P. Hodges, Baltimore; Harold W. Fowler, Severna Park; Phillip R. Anderson, Ellicott City, all of Md.

[73] Assignee: Westinghouse Electric Corp., Pittsburgh, Pa.

[21] Appl. No.: 874,977

[22] Filed: Feb. 3, 1978

[51] Int. Cl.[2] ..... F42B 19/00

[52] U.S. Cl. ..... 114/23; 114/20 R; 367/155

[58] Field of Search ..... 114/23, 20

[56] References Cited

U.S. PATENT DOCUMENTS

| | | | |
|---|---|---|---|
| 3,279,405 | 10/1966 | Billmeyer | 114/20 R |
| 3,372,662 | 3/1968 | Nisewanger | 114/20 R |

*Primary Examiner*—Samuel W. Engle
*Assistant Examiner*—Thomas H. Webb
*Attorney, Agent, or Firm*—D. Schron

[57] ABSTRACT

An acoustic homing torpedo which has an acoustic window and a nose section with the window-torpedo shell interface being positioned at a location aft of the acoustic transducers in the nose so as to minimize unwanted flow noise.

4 Claims, 6 Drawing Figures

LAMINAR FLOW QUIET TORPEDO NOSE

The government has rights in this invention pursuant to Contract No. N 60921-75-C-0141 awarded by the Department.

BACKGROUND OF THE INVENTION

1. Field of the Invention:

The invention in general relates to acoustic homing torpedoes.

2. Description of the Prior Art:

Acoustic homing torpedoes generally employ a plurality of transducer elements that are sensitive to acoustic energy generated by a target vessel. The transducers are arranged in a predetermined array behind an acoustically transparent window in the forward part of the nose section of the torpedo.

During operation, the transducers are not only sensitive to target signals, they are also responsive to energy within their frequency band that is generated as a result of the torpedo travelling through the water. At shallow running depths, the torpedo self noise may be of such magnitude that the target signal is often masked.

In one prior art torpedo, the interface between the acoustic window and the torpedo shell is located relatively close to the transducer array and although the interface is smooth, an objectionable noise is still generated close to the sensing elements.

The present invention significantly reduces this self noise by a unique acoustic window design.

SUMMARY OF THE INVENTION

The present invention includes a sensor means such as a transducer array with an acoustic window positioned in front of the sensor means. The acoustic window has a skirt portion which surrounds and extends along the nose section of the torpedo to a location so as to allow the torpedo to run at shallower depths without cavitation, as compared to prior art torpedoes. Generally, this location will be aft of the sensor means and aft of the boundary layer transition point of the torpedo at the minimum running speed. In a preferred embodiment, the skirt portion extends all the way back to the next aft section of the torpedo.

DESCRIPTION OF THE PREFERRED EMBODIMENT

Figure 1:
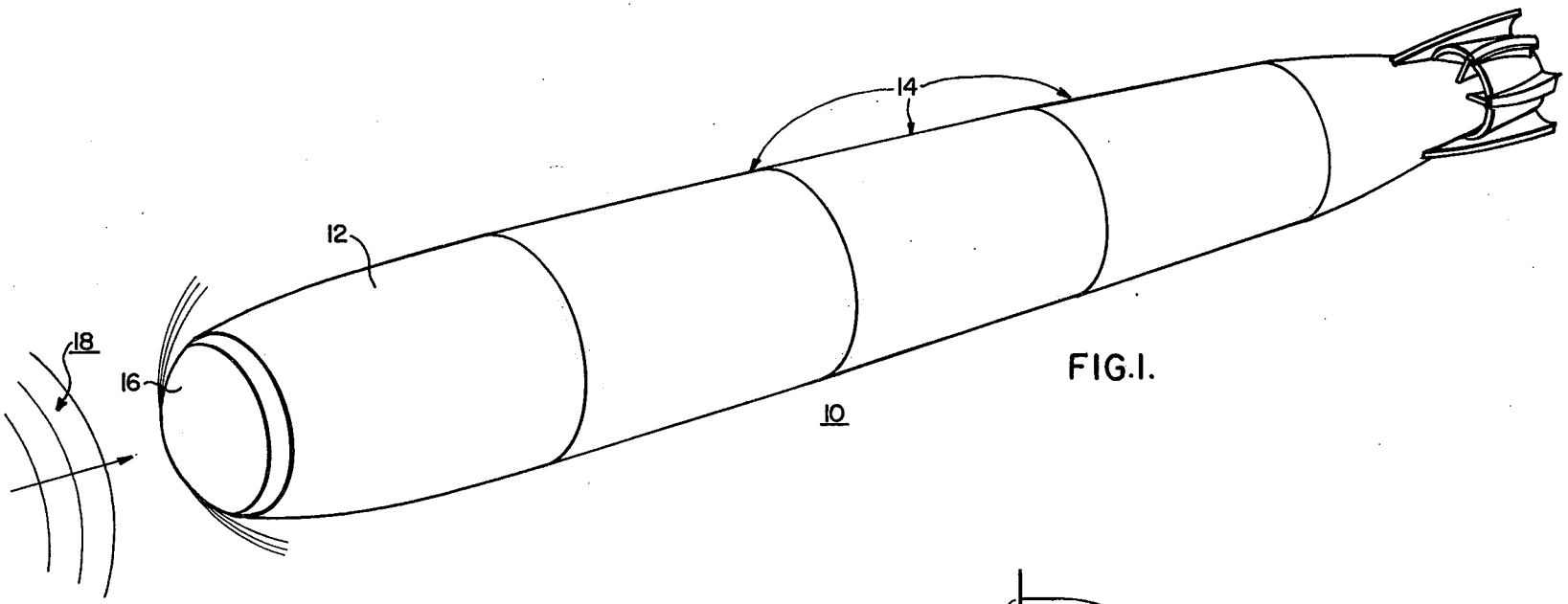
FIG. 1 illustrates a torpedo in an active operation.

In FIG. 1, there is illustrated a torpedo 10 which includes a nose section 12 and a plurality of other sections 14 which contain such components as the pay load, control circuitry, power plant, the fuel and/or battery section, etc.

Torpedo 10 is of the acoustic homing variety and includes acoustic sensing means in the nose section 12 disposed behind an acoustic window 16, made of acoustically transparent material such as polyurethane.

In operation, acoustic waves 18 emanating from a target would impinge upon acoustic window 16 and will be detected by the sensor means, generally an array of transducers. The torpedo includes signal processing and control apparatus such that in response to the target signal as evidence by acoustic waves 18, the torpedo will be controlled in such manner as to home in on the target.

Figure 2:
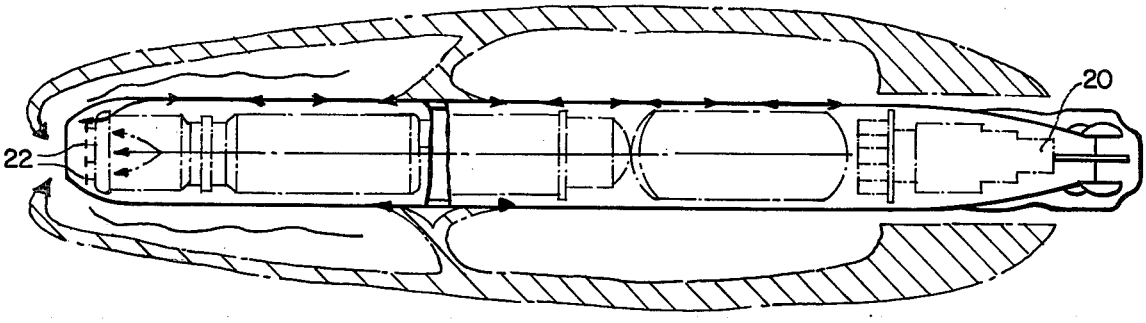
FIG. 2 is a sectional view of a torpedo illustrating several parts in phantom outline and further illustrating noise sources.

A difficulty arises, however, in that the target signal is not the only acoustic signal being sensed by the transducer array. For example, as illustrated in FIG. 2, noise from the torpedo engine 20 travels by a direct path through the water to the transducer array 22. This noise, which may include frequencies in the range detected by the transducers is also transmitted to the transducer array by various other paths such as through the water and then through the torpedo shell, through the torpedo shell directly, and through the interior space of the torpedo. Additionally, as the transducer travels through the water, the flow induced vibration similarly results in unwanted acoustic signals and the transducer array is generally mounted in an effect to minimize the response to these extraneous and unwanted signals.

For deep depth targets, the torpedo is able to accelerate to relatively high speeds without generating self noise that exceeds the signal of the target. However, when the target is a surface vessel, the torpedo is run at a relatively shallow depth where cavitation occurs resulting in the ultimate formation and violent colapse of vapor bubbles in a region relatively close to the sensor array so as to degrade optimum performance.

Figure 3:
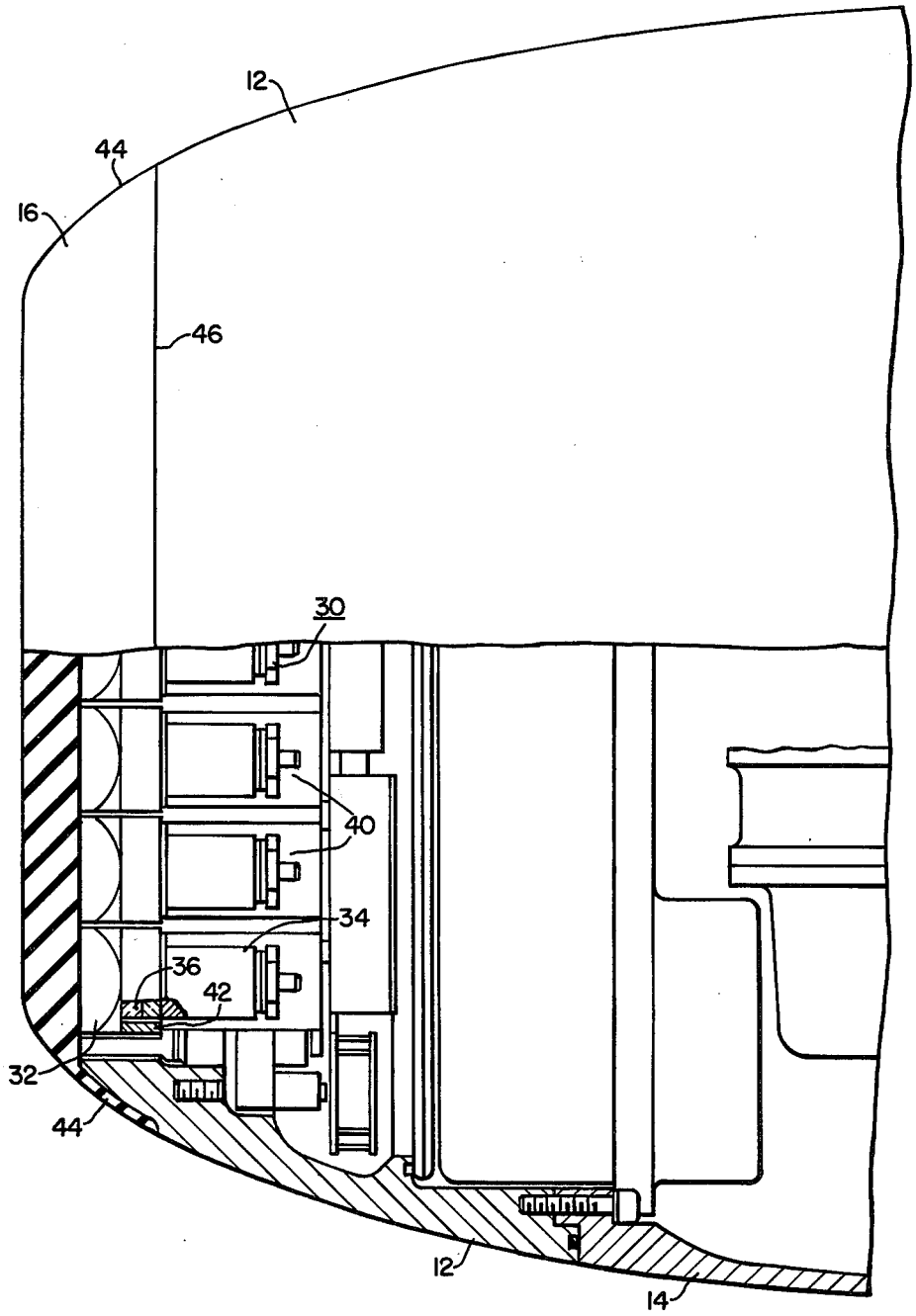
PRIOR ART FIG. 3.
FIG. 3 is a side view, partially in section, of the nose portion of the torpedo of the prior art.

FIG. 3 is a view of the forward portion of the torpedo 10 of FIG. 1, with the nose portion 12 being broken away to show the interior thereof. The sensor array includes a plurality of transducers 30 of the Tonpilz variety with each including a head mass 32, tail mass 34, and piezoelectric active section 36. The transducers are mounted in a support structure 40 having a plurality of apertures therethrough for receipt of the tail mass assembly with a support ring 42 being interposed between the rear surface of the head mass 32 and support member 40.

The front faces of the transducer head masses 32 are glued to the acoustic window 16 which has a skirt portion 44 which extends down the nose section 12 to a location even with the active section of the transducers and forming at this location a transducer window-shell interface 46.

As the torpedo goes more shallow at a fixed speed, cavitation is initiated by irregularities on the surface of the torpedo. Cavitation normally is initiated at a point referred to as the minimum pressure point, this point being a function of the shape of the nose. Any irregularity between this minimum pressure point and the forwardmost point of the torpedo can cause cavitation to take place forward of the minimum pressure point and additionally, at deeper depths for a given speed. It has been determined that interface 46 represents just such irregularity even though the transition from window to shell is smooth to the touch.

Figure 4:
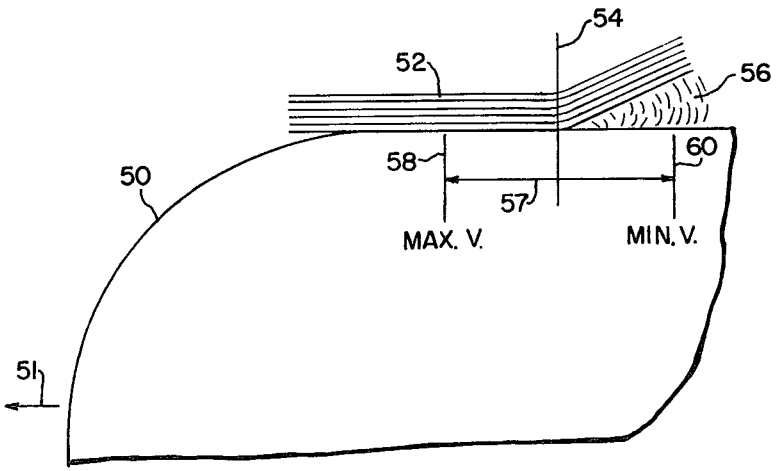
FIG. 4 illustrates a body travelling through a fluid medium to demonstrate the concept of boundary layer transition points.

Interface 46 is also instrumental in varying the boundary layer transition point which is a function of speed, shape and surface roughness of the torpedo. For example, with reference to FIG. 4, there is illustrated a body 50 travelling through a fluid medium in the direction of the arrow 51. The fluid, as represented by numeral 52, flows over the body 50 in layers or laminas. At point, or location 54, secondary irregular motions and velocity fluctuations are superimposed on the average flow which then becomes turbulent as indicated by numeral 56. This point is called the boundary layer transition point. As indicated by arrow 57, this boundary layer transition point may vary its position in accordance with the relative speed of body 50 through the fluid medium. The two extremes of boundary layer transition points are designated 58 for the location at maximum speed and 60 for the location at minimum speed.

It has been further determined that the transducer window-shell interface of the prior art moved the boundary layer transition point up further toward the nose of the torpedo to a position where the turbulent flow contributed to degraded target signal acquisition.

Figure 5:
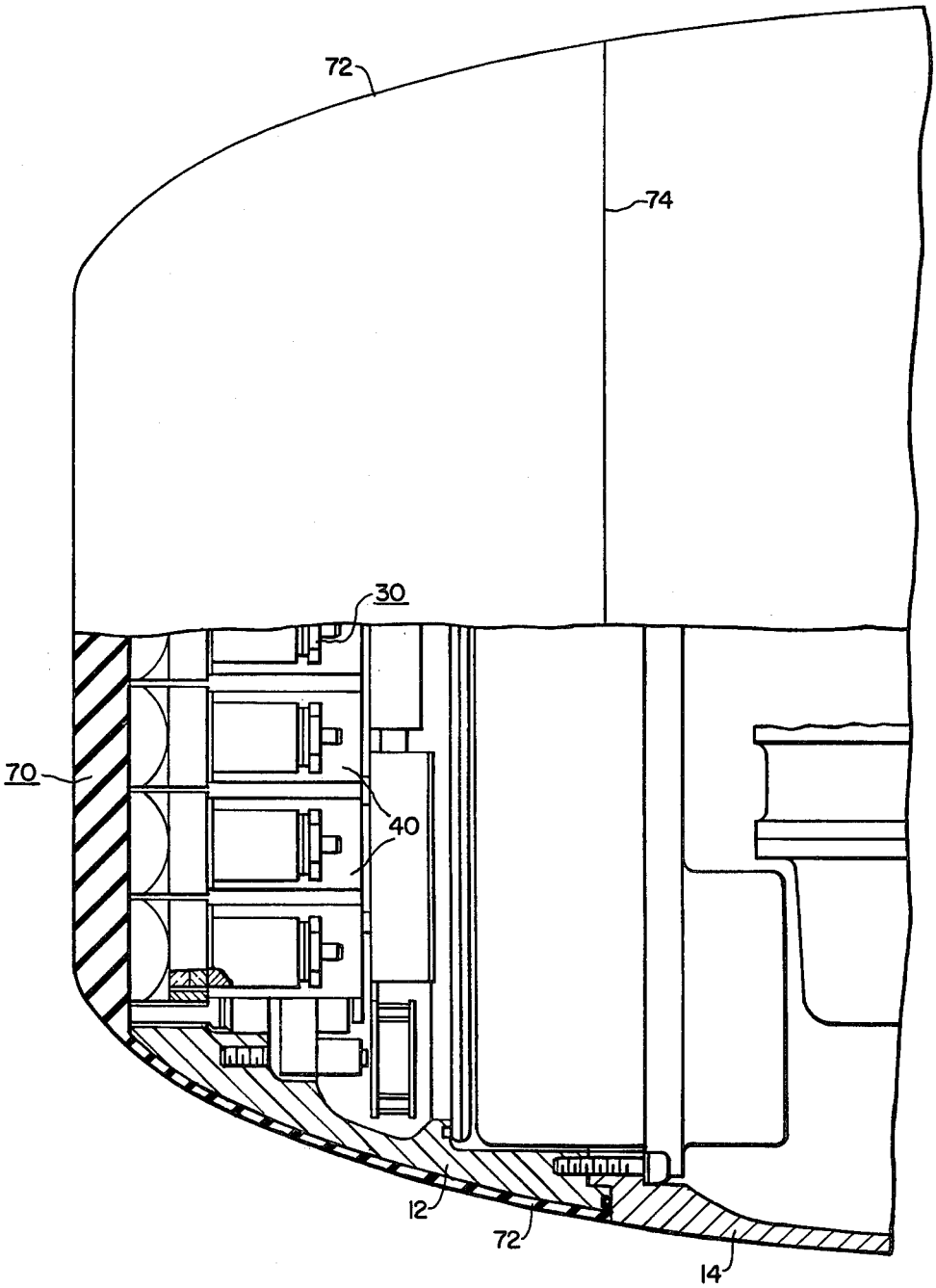
FIG. 5 is a side view, partially in section, of the preferred embodiment of the present invention.

With the present invention, the deleterious effects of the prior art construction are minimized. One embodiment of the invention is illustrated in FIG. 5 wherein many components have been given the same reference numerals as those in FIG. 3. The torpedo of FIG. 5 includes an acoustic window 70 positioned in front of the transducers 30 and which includes a skirt portion 72 which surrounds and extends along the nose section 12 to a location behind the transducers 30 and to a location which is behind the boundary layer transition point at the minimum running speed (for example, behind location 60 of FIG. 4). In a preferred embodiment, the skirt portion 72 of acoustic window 70 extends all the way back to the next aft torpedo section 14 so as to form interface 74 at a position distant enough from the acoustic sensors so as to eliminate the occurrence of a premature boundary layer transition point and/or premature cavitation.

The acoustic window may be formed of polyurethane and for back fitting existing torpedoes, the nose section 12 may be machined on the surfaces thereof to a distance to accommodate the thickness of skirt portion 71 so that its surface forms a smooth transition to the next aft section 14 at the interface 74.

Figure 6:
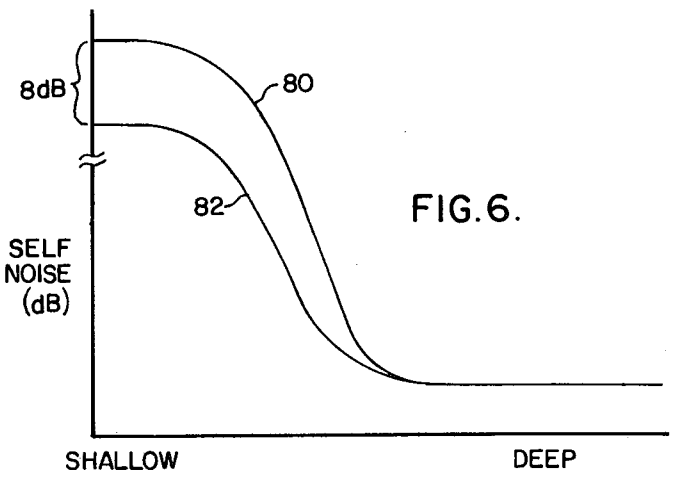
FIG. 6 are curves illustrating improved performance of the present invention over that of the prior art.

FIG. 6 illustrates the results of actual tests performed on the prior art torpedo of FIG. 3 and the improvement of FIG. 5. Curve 80 is a curve of self noise, in decibels, as a function of depth, with the prior art torpedo while curve 82 is for the torpedo of FIG. 5. For deep depths, no difference is seen in the operation of the torpedoes, however, at shallow depths, self noise measurements indicate an 8 decibel improvement of the invention over that of the prior art. This 8 decibel difference in self noise results in greater than 50% increase in closure rate at shallow depths.

Accordingly, with the location of the interface of the present invention, the torpedo will be able to run at a more shallow depth since the determining factor for the minimum pressure point at which cavitation begins will be the shape of the nose. Additionally, the location of the interface with the present invention ensures that the torpedo may be designed such that the turbulent flow which generates noise at the boundary layer transition point is located well aft of the transducer array.

What is claimed is:

1. In a torpedo having a nose section and acoustic sensor means in said nose section, said torpedo having a boundary layer transition point which is a function of torpedo speed, shape and surface roughness, the improvement comprising:

(A) an acoustic window positioned in front of said sensor means;

(B) said acoustic window having a skirt portion which surrounds and extends along said nose section to a location aft of said boundary layer transition point location at the minimum running speed of said torpedo.

2. Apparatus according to claim 1 wherein:

(A) said sensor means includes a plurality of Tonpilz transducers each having a head mass positioned against said acoustic window, a tail mass, and an active section; and (B) said skirt portion extending to a locaion aft of said tail masses of said transducers.

3. Apparatus according to claim 1 wherein:

(A) said skirt portion is flush with the surface of said nose section.

4. Apparatus according to claim 1 wherein:

(A) said skirt portion extends back to the next aft section of said torpedo.

* * * * *